US006508377B1

(12) United States Patent
Griswold et al.

(10) Patent No.: US 6,508,377 B1
(45) Date of Patent: Jan. 21, 2003

(54) MULTIPLE-SECTIONAL GARBAGE CONTAINER

(76) Inventors: Susan K. Griswold, 1727 Algema Blvd., Oshkosh, WI (US) 54901; Brian K. Casperson, 1727 Algema Blvd., Oshkosh, WI (US) 54901

( * ) Notice: Subject to any disclaimer, the term of this patent is extended or adjusted under 35 U.S.C. 154(b) by 0 days.

(21) Appl. No.: 09/770,624

(22) Filed: Jan. 26, 2001

(51) Int. Cl.[7] ..... B65D 90/00

(52) U.S. Cl. ..... 220/495.06; 220/603; 220/908; 220/908.1

(58) Field of Search ..... 220/908, 495.06, 220/908.1, 603

(56) References Cited

U.S. PATENT DOCUMENTS 3,927,786 A 12/1975 Aboud
4,167,271 A 9/1979 Jorgensen
4,303,170 A * 12/1981 Panicci ..... 220/603
4,872,582 A * 10/1989 Sipple ..... 220/603
D342,817 S 12/1993 Lippisch et al.
5,419,453 A 5/1995 Lochridge
5,477,881 A * 12/1995 Fujinaka et al. ..... 220/603
5,562,229 A 10/1996 Callahan
5,897,018 A 4/1999 Pruitt

* cited by examiner

*Primary Examiner*—Joseph M. Moy

(57) ABSTRACT

A multiple-sectional garbage container for providing a safer and less strenuous manner of removing a trash bag from the garbage container. The multiple-sectional garbage container includes a base member including a bottom wall, a side wall, and an open top; and also includes an elongate tubular member including a side wall, an open bottom, an open top, and an opening therethrough and being removably fastened upon the base member with the opening being adapted to receive a garbage bag; and further includes a lid member being removably disposed upon the open top of the elongate tubular member; and also includes a plurality of handle/latch members being pivotally attached to the elongate tubular member and being fastenable to the base member.

1 Claim, 2 Drawing Sheets

MULTIPLE-SECTIONAL GARBAGE CONTAINER

BACKGROUND OF THE INVENTION

1. Field of the Invention

The present invention relates to a dual-opening garbage can and more particularly pertains to a new multiple-sectional garbage container for providing a safer and less strenuous manner of removing a trash bag from the garbage container.

2. Description of the Prior Art

The use of a dual-opening garbage can is known in the prior art. More specifically, a dual-opening garbage can heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,927,786; U.S. Pat. No. 5,562,229; U.S. Pat. No. 5,419,453; U.S. Pat. No. 4,167,271; U.S. Pat. No. 5,897,018; and U.S. Pat. No. Des. 342,817.

While these devices fulfill their respective, particular objectives and requirements, the aforementioned patents do not disclose a new multiple-sectional garbage container. The inventive device includes a base member including a bottom wall a side wall, and an open top; and also includes an elongate tubular member including a side wall, an open bottom, an open top, and an opening therethrough and being removably fastened upon the base member with the opening being adapted to receive a garbage bag; and further includes a lid member being removably disposed upon the open top of the elongate tubular member; and also includes a plurality of handle/latch members being pivotally attached to the elongate tubular member and being fastenable to the base member.

In these respects, the multiple-sectional garbage container according to the present invention substantially departs from the conventional concepts and designs of the prior art, and in so doing provides an apparatus primarily developed for the purpose of providing a safer and less strenuous manner of removing a trash bag from the garbage container.

SUMMARY OF THE INVENTION

In view of the foregoing disadvantages inherent in the known types of dual-opening garbage can now present in the prior art, the present invention provides a new multiple-sectional garbage container construction wherein the same can be utilized for providing a safer and less strenuous manner of removing a trash bag from the garbage container.

The general purpose of the present invention, which will be described subsequently in greater detail, is to provide a new multiple-sectional garbage container which has many of the advantages of the dial-opening garbage can mentioned heretofore and many novel features that result in a new multiple-sectional garbage container which is not anticipated, rendered obvious, suggested, or even implied by any of the prior art dual-opening garbage can, either alone or in any combination thereof.

To attain this, the present invention generally comprises a base member including a bottom wall, a side wall, and an open top; and also includes an elongate tubular member including a side wall, an open bottom, an open top, and an opening therethrough and being removably fastened upon the base member with the opening being adapted to receive a garbage bag; and further includes a lid member being removably disposed upon the open top of the elongate tubular member; and also includes a plurality of handle/latch members being pivotally attached to the elongate tubular member and being fastenable to the base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple-sectional garbage container which has many of the advantages of the dual-opening garbage can mentioned heretofore and many novel features that result in a new multiple-sectional garbage container which is not anticipated, rendered obvious, suggested, or even implied by any of the prior art dual-opening garbage can, either alone or in any combination thereof.

It is another object of the present invention to provide a new multiple-sectional garbage container which may be easily and efficiently manufactured and marketed.

It is a further object of the present invention to provide a new multiple-sectional garbage container which is of a durable and reliable construction.

An even further object of the present invention is to provide a new multiple-sectional garbage container which is susceptible of a low cost of manufacture with regard to both materials and labor, and which accordingly is then susceptible of low prices of sale to the consuming public, thereby making such multiple-sectional garbage container economically available to the buying public.

Still vet another object of the present invention is to provide a new multiple-sectional garbage container which provides in the apparatuses and methods of the prior art some of the advantages thereof, while simultaneously overcoming some of the disadvantages normally associated therewith.

Still another object of the present invention is to provide a new multiple-sectional garbage container for providing a safer and less strenuous manner of removing a trash bag from the garbage container.

Yet another object of the present invention is to provide a new multiple-sectional garbage container which includes a base member including a bottom wall, a side wall, and an open top; and also includes an elongate tubular member including a side wall, an open bottom, an open top, and an opening therethrough and being removably fastened upon the base member with the opening being adapted to receive a garbage bag; and further includes a lid member being removably disposed upon the open top of the elongate tubular member; and also includes a plurality of handle/latch members being pivotally attached to the elongate tubular member and being fastenable to the base member.

Still yet another object of the present invention is to provide a new multiple-sectional garbage container that allows the user to easily remove the garbage bag without having to lift it out of the garbage container.

Even still another object of the present invention is to provide a new multiple-sectional garbage container that reduces back injuries to the users.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
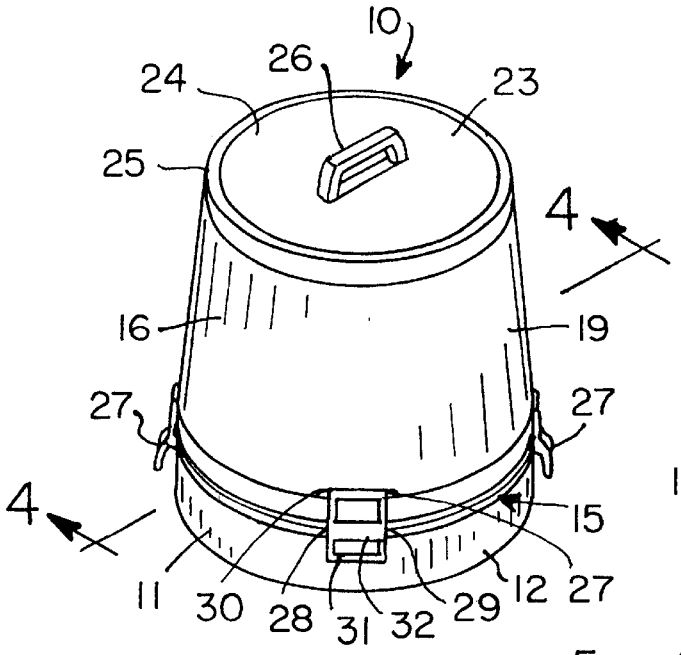
FIG. 1 is a perspective view of a new multiple-sectional garbage container according to the present invention.
Figure 2:
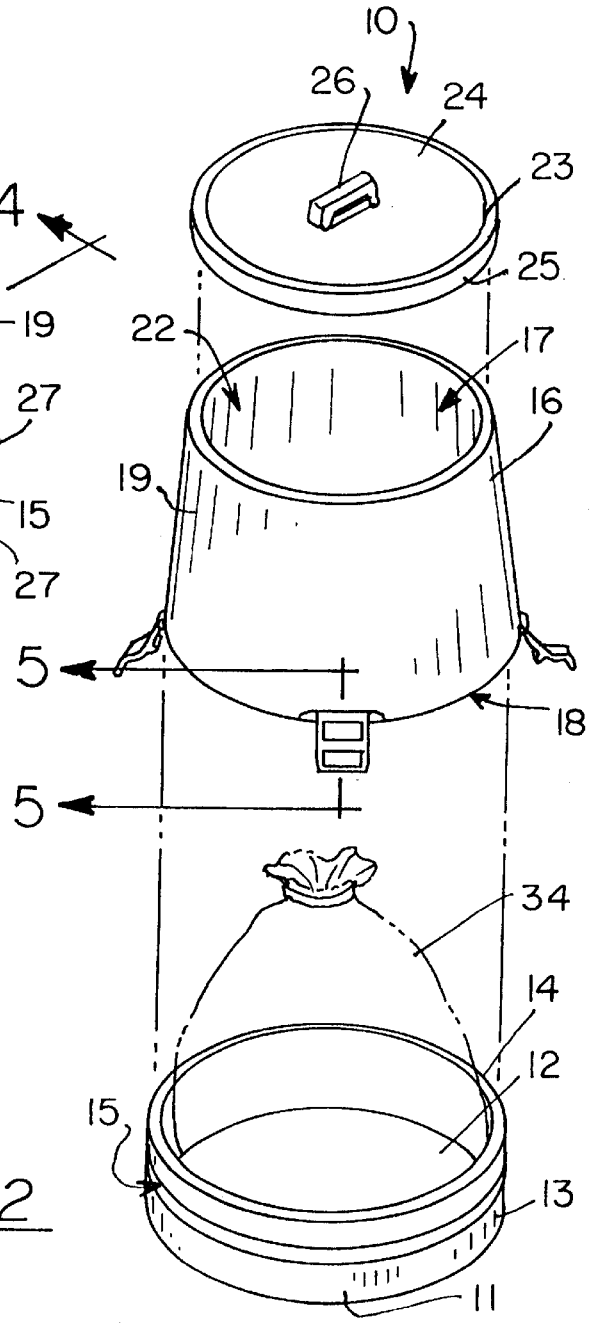
FIG. 2 is an exploded perspective view of the present invention.
Figure 3:
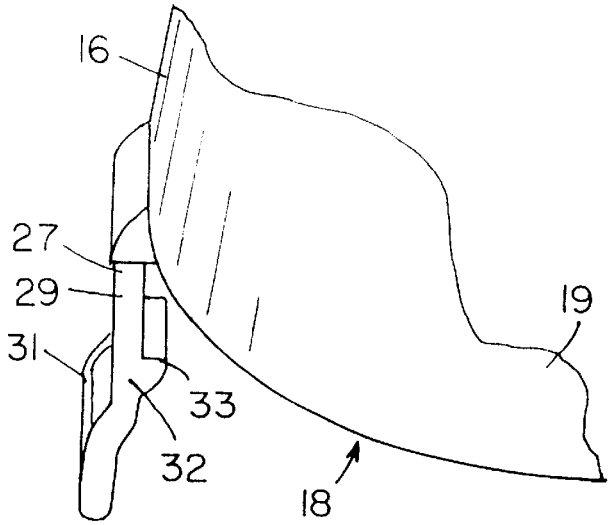
FIG. 3 is a detailed cross-sectional view of one of the handle/latch members of the present invention.
Figure 4:
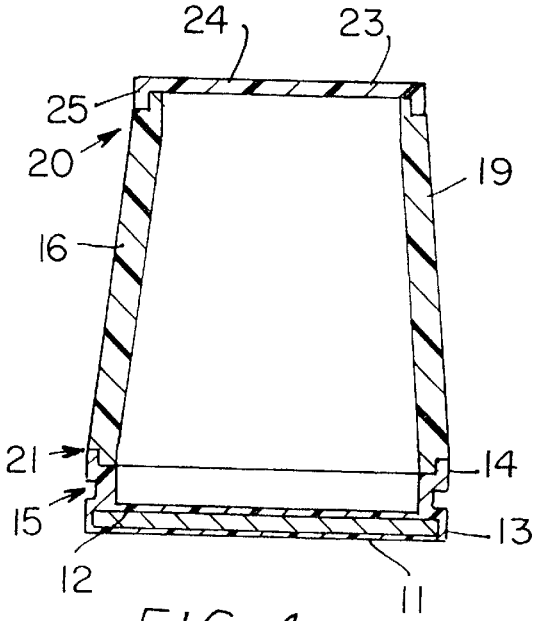
FIG. 4 is a cross-sectional view of the present invention.
Figure 5:
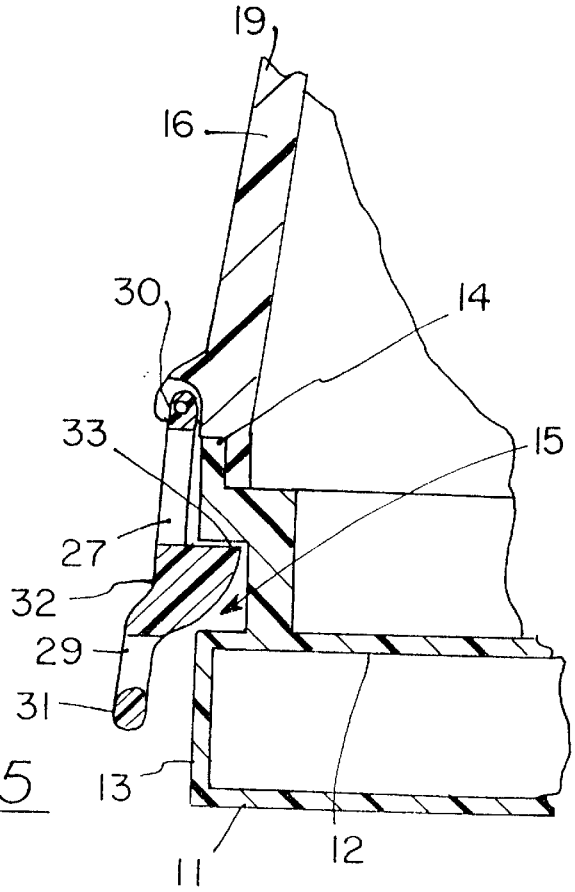
FIG. 5 is a cross-sectional view of one of the handle/latch members of the present invention.

With reference now to the drawings, and in particular to FIGS. 1 through 5 thereof, a new multiple-sectional garbage container embodying the principles and concepts of the present invention and generally designated by the reference numeral 10 will be described.

As best illustrated in FIGS. 1 through 5, the multiple-sectional garbage container 10 generally comprises a base member 11 including a weighted bottom wall 12, a side wall 3, and an open top. The base member 11 further includes an annular groove 15 being circumferentially-disposed in an exterior of the side wall 13 and near the open top of the base member 11. The base member 11 also includes a raised rim 14 being conventionally and integrally disposed along an outer top edge of the side wall 13 thereof with the base member 11 having a diameter of approximately 2 to 3 feet and having a height of approximately 6 inches.

An elongate tubular member 16 includes a side wall 19, an open bottom 18, an open top 17, and an opening 22 therethrough and is removably fastened upon the base member 11. The opening 22 is adapted to receive a garbage bag 34. The side wall 19 of the elongate tubular member 16 includes top and bottom annular recessed portions 20,21 being disposed therein at top and bottom ends thereof. The elongate tubular member 16 has a length of approximately 30 to 36 inches.

A lid member 23 is removably disposed upon the open top 17 of the elongate tubular member 16. The lid member 23 includes a top wall 24, and also includes a lip 35 being conventionally and integrally disposed along a bottom edge of the top wall 23 with the lip 25 being adapted to be removably received in the top recessed portion 20 of the elongate tubular member 16. The lid member 23 further includes a handle member 26 being securely and conventionally attached to a top of the top wall 24.

A plurality of handle/latch members 27 are pivotally and conventionally attached to the elongate tubular member 16 and are fastenable to the base member 1. Each of the handle/latch members 27 is securely and conventionally attached at the bottom end of the side wall 19 of the elongate tubular member 16, and includes a lever having elongate side members 28,29 being spaced apart and being conventionally interconnected with first and second elongate end members 30,31, and further having a cross member 32 being conventionally attached to the elongate side members 28,29. The first elongate end member 30 is hingedly and conventionally attached to the side wall 19 of the elongate tubular member 16. The second elongate end member 31 is a handle portion and is adapted to be grasped by a user. Each of the cross members 32 includes a flange portion 33 which is adapted to be removably received in the annular groove 15 of the base member 11 to securely fasten the elongate tubular member 16 to the base member 11.

In use, the user secures the elongate tubular member 16 to the base member 11 with the handle/latch members 27, and places a garbage bag 34 in the opening 22 of the elongate tubular member 16 and upon the base member 11 and closes the open top 17 of the elongate tubular member 16 with the lid member 23. Once the garbage bag 34 is filled, the user then unfastens the handle/latch members 27 from the base member 11 and lifts the elongate tubular member 16 off the base member 11 and removes the garbage bag 34 from upon the base member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A multiple-sectional garbage container comprising:

a base member including a bottom wall, a side wall, and an open top, said bottom wall of said base member defining a substantially closed chamber for receiving a weighting material therein, said base member further including an annular groove being circumferentially-disposed in an exterior of said side wall and near said open top of said base member, said base member also including a raised rim being disposed along an outer top edge of said side wall thereof, said base member having a diameter of approximately 2 to 3 feet and having a height of approximately 6 inches;

an elongate tubular member including a side wall, an open bottom, an open top, and an opening therethrough, and being removably fastened upon said base member, said opening being adapted to receive a garbage bag said side wall of said elongate tubular member including top and bottom annular recessed portions being disposed therein at top and bottom ends thereof, said elongate tubular member having a length of approximately 30 to 36 inches;

a lid member being removably disposed upon said open top of said elongate tubular member, said lid member including a top wall, and also including a lip being disposed along a bottom edge of said top wall, said lip being adapted to be removably received in said top recessed portion of said tubular member, said lid member further including a handle member being securely attached to a top of said top wall; and a plurality of handle/latch members being pivotally attached to said elongate tubular member and being fastenable to said base member, each of said handle/latch members being securely attached at said bottom end of said side wall of said elongate tubular member, and including a lever having elongate side members being spaced apart and being interconnected with first and second elongate end members, and further having a cross member being attached to said elongate side members, said first elongate end member being hingedly attached to said side wall of said elongate tubular member, said second elongate end member being a handle portion and being adapted to be grasped by a user, each of said cross members including a flange portion which is adapted to be removably received in said annular groove of said base member to securely fasten said elongate tubular member to said base member;

wherein said bottom wall of said base member includes a top panel, a bottom panel, and a perimeter panel extending between said top and bottom panels for enclosing said chamber, said top and bottom panels being substantially parallel to each other, and a weighting material being positioned in said chamber.

* * * * *